US005681225A

United States Patent [19]

Cary

[11] Patent Number: 5,681,225

[45] Date of Patent: Oct. 28, 1997

[54] GOLF CLUB SWING TRAINING APPARATUS

[76] Inventor: John F. Cary, 5707 Wichita, Fort Worth, Tex. 76119

[21] Appl. No.: 730,467

[22] Filed: Oct. 11, 1996

[51] Int. Cl.[6] ..... A63B 69/36

[52] U.S. Cl. ..... 473/229; 119/792; 119/795; 285/272; 285/322; 285/398; 482/91; 482/129

[58] Field of Search ..... 473/229, 231, 473/238; 119/792, 795; 285/272, 322, 398; 482/91, 121, 129

[56] References Cited

U.S. PATENT DOCUMENTS

| | | | |
|---|---|---|---|
| Re. 32,397 | 4/1987 | Self et al. . | |
| 3,703,294 | 11/1972 | Fitch . | |
| 4,353,556 | 10/1982 | Self et al. . | |
| 4,662,640 | 5/1987 | Grander . | |
| 4,693,479 | 9/1987 | McGwire . | |
| 5,538,251 | 7/1996 | Harper | 473/229 |

*Primary Examiner*—George J. Marlo
*Attorney, Agent, or Firm*—Arthur F. Zobal

[57] ABSTRACT

The apparatus includes an annular member having a pivotal member pivotally coupled to the annular member to which an elongated elastic member may be attached with the other end of the elastic member attached to a fixed object. Two clamp members are provided each of which has an enlarged base with a neck extending from one end of the base and a collar formed at the other end of the neck such that a curved slot is located on the outside of the clamp member between the base and the collar. The base of each of clamp member has first flattened portions on opposite sides of a first slot and the neck and collar of each clamp member has second flattened portions on opposite sides of a second slot which is a continuation of the first slot. The first flattened portions of the bases of the two clamp members may engage each other such that the second flattened portions and second slots extend away from each other. With the shaft of a golf club extending through the opening of the annular member, the second flattened portions may be moved together when the clamp members are located around the shaft of the golf club to allow the two collars to be moved through the opening of the annular member. The two bases are secured together around the golf club to maintain the annular member in the outer slots formed between the two collars and the two bases.

4 Claims, 3 Drawing Sheets

Fig.7
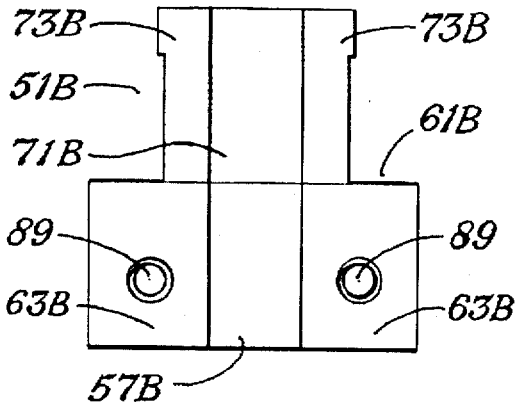
Fig.6
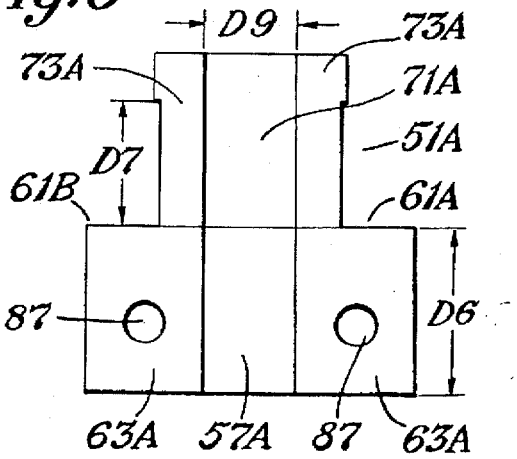
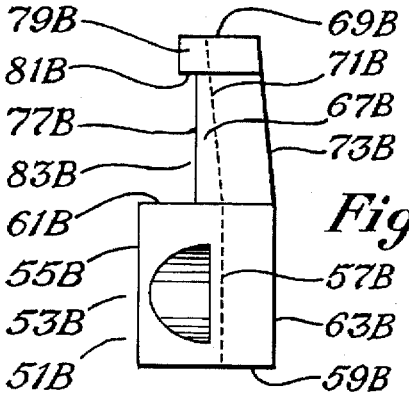
Fig.9
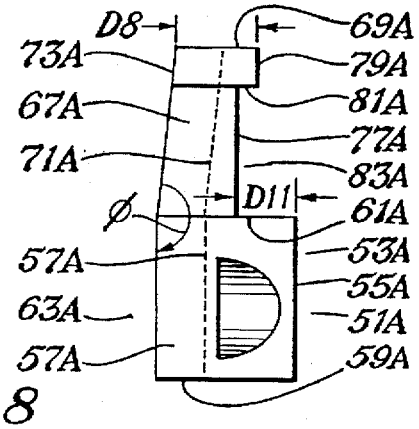
Fig.8
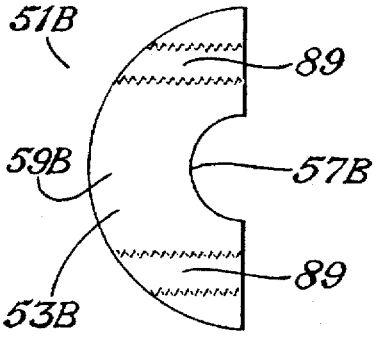
Fig.11
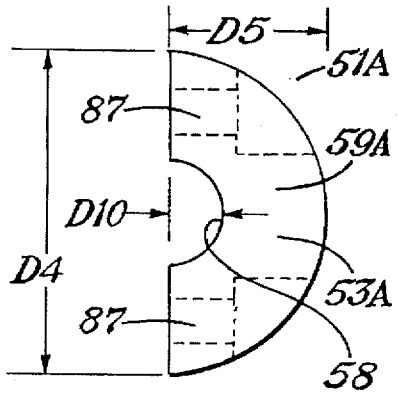
Fig.10
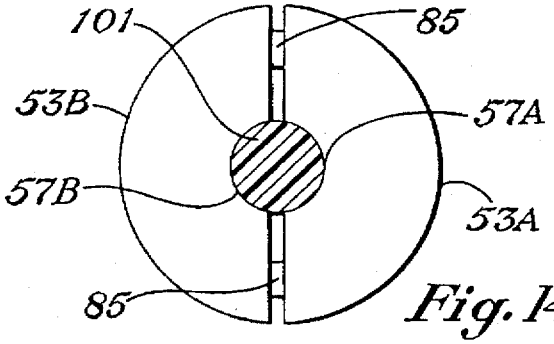
Fig.14

GOLF CLUB SWING TRAINING APPARATUS

BACKGROUND OF THE INVENTION

1. Field of the Invention

The invention relates to a device for use for training a golfer to properly swing a golf club.

2. Description of the Prior Art

U.S. Pat. Nos. 32,397; 3,703,294; 4,353,556; 4,662,640; and 4,693,479 disclose devices for use for training a golfer to swing a golf club.

I have found that the only part of the golf swing which should be considered critical is a defined space between one's right knee and some point outside of one's left side depending on whether one plays the ball abnormally forward of center or uses an unconventional stance which would cause a swing different than what I consider a normal swing plane. There is approximately a 50 degree arc at the bottom of the swing which is the ideal accelerating zone through impact. It is in this area that maximum strength and coordination occurs when swinging a golf club. The mass of the body mm and consolidation of forces generated by the arc are at their peak during this split second while passing the ball. All of one's preparation from address to the point of extension should be a passive composition of positioning oneself to reach this point poised for a graceful pass through the ball.

SUMMARY OF THE INVENTION

It is an object of the invention to provide a device to allow one to show oneself and analyze what errors one may need to work on to improve one's handicap and enjoy the game of golf more.

The apparatus comprises an annular member having pivotal means pivotally coupled to the annular member to which an elongated elastic member may be attached with the other end of the elastic member attached to a fixed object. Two clamp members are provided each of which has an enlarged base with a neck extending from one end of the base and a collar formed at the other end of the neck such that a curved slot is located on the outside of the clamp member between the base and the collar. The base of each clamp member has first flattened portions on opposite sides of a first slot and the neck and collar of each clamp member has second flattened portions on opposite sides of a second slot which is a continuation of the first slot. The first flattened portions of the bases of the two clamp members may engage each other such that the second flattened portions extend away from each other. With the shaft of a golf club extending through the opening of the annular member, the second flattened portions may be moved together when located around the shaft of the golf club to allow the two collars to be moved through the opening of the annular member. The two bases are secured together around the golf club to maintain the annular member in the slots formed between the two collars and the two bases.

BRIEF DESCRIPTION OF THE DRAWINGS

FIGS. 6 and 7 are plan view of the insides of the two clamp members of FIG. 3.

FIGS. 8 and 9 are side views of the two clamp members of FIG. 3.

FIGS. 10 and 11 are plan views of the base portions of the two clamp members of FIGS. 6–9.

FIG. 14 illustrates the device of the invention clamped around the shaft of a golf club.

DESCRIPTION OF THE PREFERRED EMBODIMENT

Figure 13:
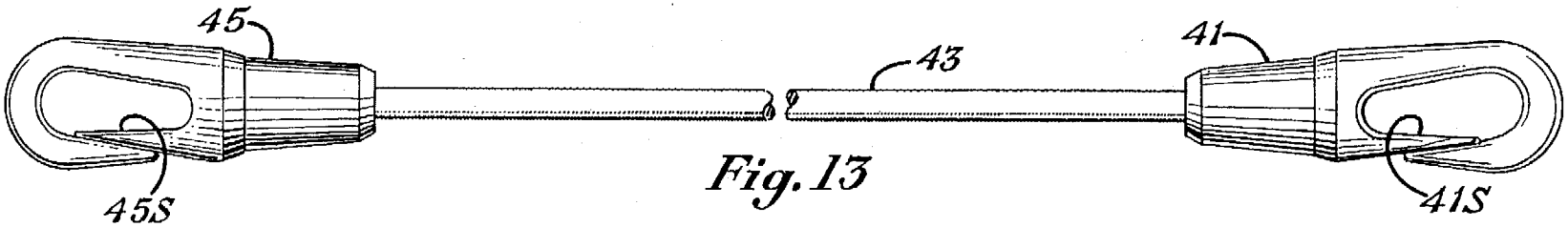
FIG. 13 illustrates an elongated elastic member with clips for use with the device of FIGS. 1–11.

Referring now to FIGS. 1–11, the apparatus of the invention is identified by reference numeral 21. It comprises an annular member 23 and two clamp members 51A and 51B. The member 23 has a circular outer surface 25, a central circular opening 27 extending therethrough and two flat ends 29 and 31. Two studs or ears 33 and 35 are connected to the outer surface 25 about 180° apart. A V-shaped metal wire member 37 has two arms 37A and 37B with their ends 37AE and 37BE pivotally coupled to the studs 33 and 35 respectively. The member 37 has a pointed central portion 37P to which the clip 41 of an elongated elastic member 43 (See FIG. 13) may be releasably coupled. In use, the clip 45 at the other end of the strand 43 may be releasably coupled to a fixed object or structure 47 such as a door, wall, building, etc. Note FIG. 12A, B, C. In FIG. 13 the clips 45 and 47 have spring members 45S and 47S.

The two clamp members 51A and 51B are identical except for the two bolt holes formed through the members. In the description and drawings herein the components of member 51A are identified with the suffix A and the corresponding components of member 51B are identified with the suffix B. Referring to member 51A, it comprises a base 53A having curved outer surface 55A, a slot or curved inner surface 57A, an end 59A, an opposite end shoulder 61A and two flat surfaces 63A on opposite sides of the slot 57A. The two surfaces 63A are in the same plane. Extending from the shoulder end 61A is a neck 67A having a collar 69A attached to its opposite end. The neck 67A and collar 69A have a slot or curved inner Surface 71A and two flat surfaces 73A on opposite sides of the slot 71A and which are in the same plane. The neck 67A has a curved outer surface 77A. The collar 69A has a curved outer surface 79A with a shoulder 81A formed between surface 79A and neck surface 77A such that a curved slot 83A is formed between the collar 69A and the base 53A. The surfaces 63A and 73A are in different planes which define an obtuse angle θ of about 175°. The apexes of the slots 57A, 71A and 57B, 71B are parallel to the planes of surfaces 63A, 73A and 63B, 73B respectively.

Figure 1:
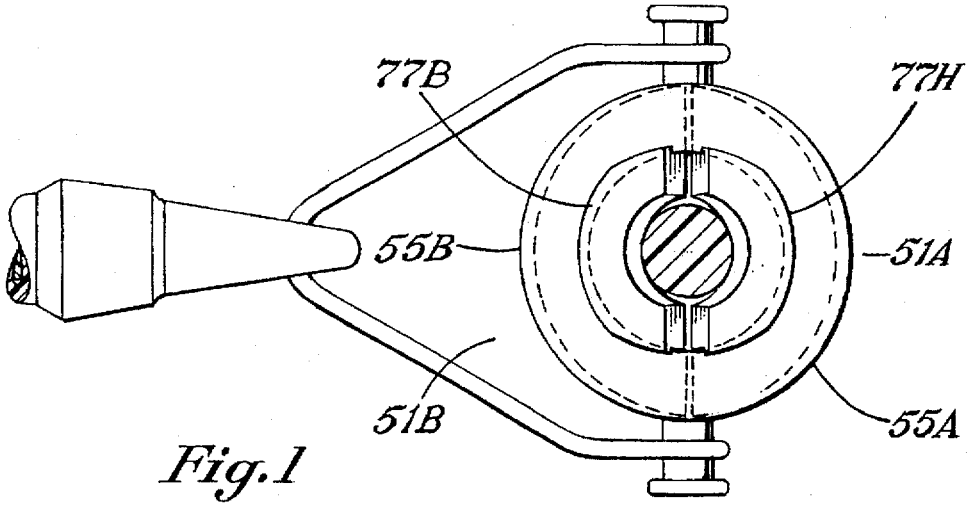
FIG. 1 is a top plan view of the apparatus of the invention.
Figure 3:
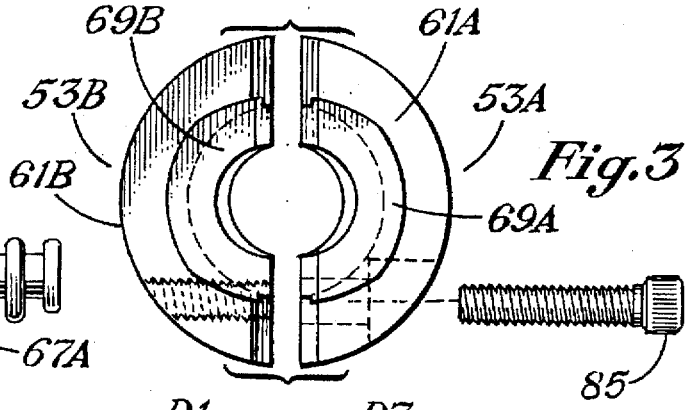
FIG. 3 is a top plan view of two clamp members of the apparatus of FIG. 1.
Figure 5:
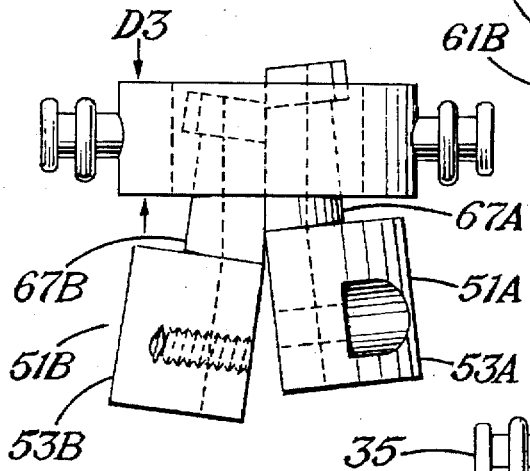
FIG. 5 illustrates the two clamp members of FIG. 3 being inserted through the central opening of the annular member of FIG. 4.
Figure 4:
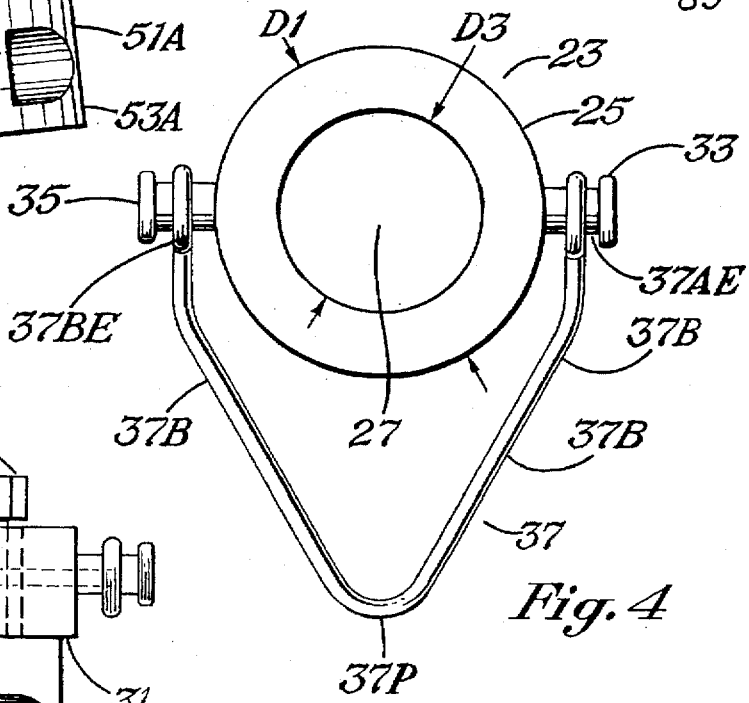
FIG. 4 is a plan view of the annular member of the apparatus of FIGS. 1 and 2.
Figure 2:
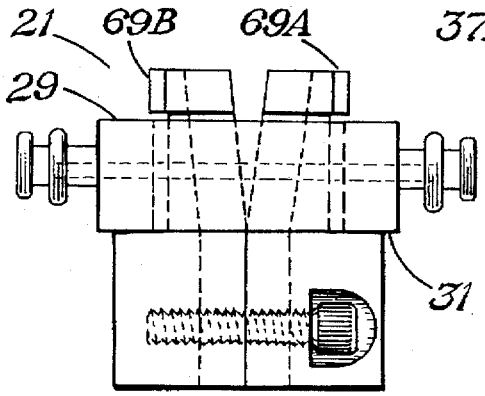
FIG. 2 is a side view of the apparatus of FIG. 1 as seen from the right of FIG. 1.

When the surfaces 73A and 73B engage each other, the collars 69A and 69B can be passed through the opening 27 of the annular member 25 as seen in FIG. 5 to locate the annular member 25 around the slots 83A and 83B as seen in FIG. 2. The surfaces 63A and 63B can be made to engage each other as seen in FIG. 2. In this position, the collars 69A and 69B are spread outward relative to each other and the collars 69A and 69B and the bases 53A and 53B maintain the armular member. 23 in the slots 83A and 83B. The two clamp members 53A and 53B can be secured together in the position shown in FIG. 2 by locating bolt 85 in apertures 87 formed through base 53A of member 51A and screwing the bolts 85 into threaded apertures 89 formed through base 53B of member 51B.

Figure 12:
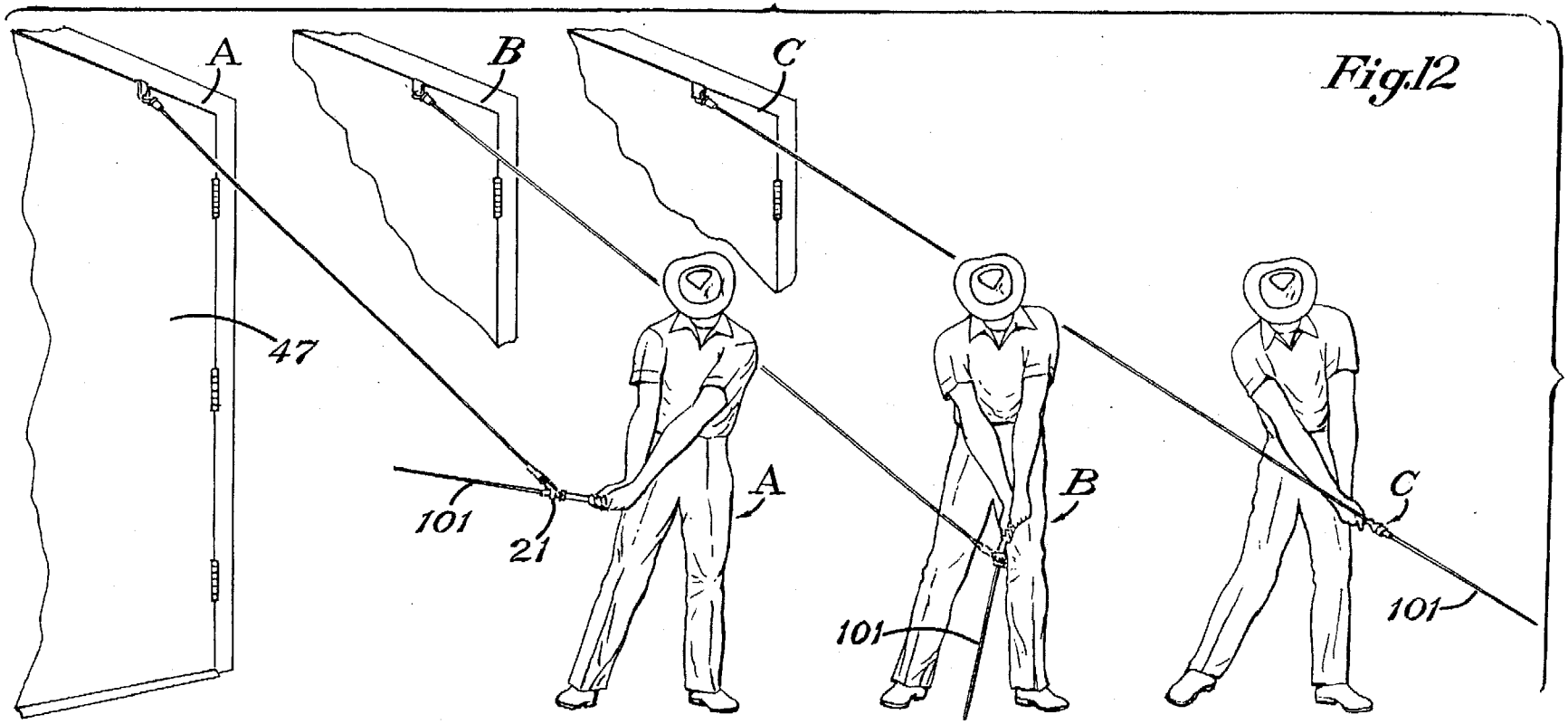
FIG. 12A, B, C illustrates the invention in use.

In using the apparatus, the annular member 23 is located around the shaft 101 of a golf club by inserting the handle of the golf club through the opening 27. In FIG. 12A, B, C the head of the golf club is not shown. The clamp members 51A and 51B are located around the shaft, with the shaft in the slots 57A, 57B, and 71A, 71B. The surfaces 73A and 73B are moved together to allow one to pass the collars 69A and 69B through the opening 27 of the member 23 to locate the member 23 in the slots 83A and 83B and the two members 53A and 53B are secured together around the golf shaft with the bolts 85. This spreads the collars 69A and 69B apart to maintain the member 23 in the slots 83A and 83B. In the secured position, the apexes of the slots 57A and 57B will securely engage opposite sides of the shaft 101 of the golf club to securely clamp the members 51A and 51B to the shaft. The clip 41 of the elastic member 43 is fitted around the pointed portion 37A of the wire member 37 and the other clip 45 is secured to a loop, nail, hook, etc. coupled to the structure 47.

The wire member 37 can pivot relative to the annular member 23 and the annular member 23 can rotate in the slot 83A, 83B relative to the clamps 51A, 51B which are secured to and around the shaft of the golf club. While training with the invention, the user can use the device to teach one to maintain the golf club in the same plane as the golf club is swung and approaches and passes through the 50 degree are space referred to previously.

Preferably the device will be attached to the shaft 101 of the golf club next to the grip as shown in FIG. 12A, B, C. This creates a balancing point when using the golf club. As the user progresses with the swing, the elastic member 43 is stretched. The device allows one to see if the golf club is swinging in the same plane and coordinates the muscles one uses when he plays golf. It also allows one to correct a faulty grip. When the golf club is held in a status position i.e. over one's left thigh (with the device secured to the shaft of the golf club), one can feel his weight distribution, body turn and the check his hand position In one embodiment D1 is about $1\frac{13}{16}$ inches; D2 is about $1\frac{1}{16}$ inches; D3 is about $\frac{11}{16}$ of an inch; D4 is about $1\frac{13}{16}$ inches; D5 is about $\frac{14}{16}$ of an inch; D6 is about $\frac{14}{16}$ of an inch; D7 is about $\frac{12}{16}$ of an inch; D8 about is $\frac{7}{16}$ of an inch; D9 is about $\frac{9}{16}$ of an inch; D10 is about $\frac{3.5}{16}$ of an inch; and D11 is about $\frac{6}{16}$ of an inch. It is to be understood, that the above dimensions may vary.

Members 23, 51A and 51B may be formed of a suitable hard plastic.

I claim:

1. An apparatus to be attached to the shaft of a golf club for golf swing training purposes comprising:

an annular member having a outer side and a central opening formed therethrough for receiving the shaft of a golf club, a pivotal member having two arms pivotally coupled to the outside of said annular member and a central portion for attachment of an elastic member, first and second clamp members each having a base portion with a neck having one end coupled to said base portion with a collar formed on the other end of said neck spaced away from said base portion defining a curved outer slot between said collar and base portion of each of said clamp members, each of said clamp members having first flattened portions at its base portion on opposite sides of a first slot and second flattened portions at its neck and collar on opposite sides of a second slot with said second slot being an extension of said first slot and with said first and second flattened portions and said first and second slots being formed such that said first flattened portions may engage each other with said second flattened portions and said second slots respectively extending away from each other, said first and second slots of said first and second clamp members being adapted to receive the shaft of a golf club with said second flattened portions being adapted to engage each other to allow said two collars to be inserted through said opening of said annular member with the shaft of a golf club extending through said opening of said annular member to allow said annular member to be located around said curved outer slots of said two clamp members, said two base portions and said two collars having dimensions such that when said base portions are secured around the shaft of a golf club, said annular member may be located around said two outer slots with said two base portions and said two collars preventing said two clamp members from passing through said opening of said annular member, and means for securing said base portions of said two clamp members together around the shaft of a golf club with the shaft of a golf club located in said first and second slots with said two collars and said two base portions maintaining said annular member located around said curved outer slots of said two clamp members.

2. The apparatus of claim 1, comprising:

two studs formed on the outer side of said annular member about 180° apart, said two arms of said pivotal member being pivotally coupled to said two studs respectively.

3. The apparatus of claim 1, wherein:

said first and second flattened portions of each of said clamp members are in first and second planes which define an obtuse angle, the apexes of said first and second slots of each of said clamps are generally parallel to said first and second planes respectively.

4. The apparatus of claim 3, comprising:

two studs formed on the outer side of said annular member about 180° apart, said two arms of said pivotal member being pivotally coupled to said two studs respectively.

* * * * *